US005426806A

United States Patent [19]

Johnson et al.

[11] Patent Number: 5,426,806

[45] Date of Patent: Jun. 27, 1995

[54] SPORTS EQUIPMENT GRIP CLEANER

[75] Inventors: Dennis N. Johnson; Christopher A. Johnson, both of Federal Way, Wash.

[73] Assignee: Trio Johnson, Inc., Federal Way, Wash.

[21] Appl. No.: 262,470

[22] Filed: Jun. 20, 1994

[51] Int. Cl.[6] ..... A46B 13/04; A63B 57/00

[52] U.S. Cl. ..... 15/88.4; 15/88.3; 15/104.04

[58] Field of Search ..... 15/88.3, 88.4, 104.04, 15/88.2, 77, 74, 56, 75, 21.1

[56] References Cited

U.S. PATENT DOCUMENTS

| | | | |
|---|---|---|---|
| 1,886,853 | 11/1932 | Van Ness | 15/74 |
| 2,671,916 | 3/1954 | Zipperlin | 15/56 |
| 2,952,859 | 9/1960 | Alcamo | 15/88.3 |
| 3,148,396 | 9/1964 | Smith | 15/88.3 |
| 3,619,841 | 11/1971 | Russell et al. | 15/21.1 |
| 3,918,117 | 11/1975 | Plante | 15/88.3 |
| 4,554,696 | 11/1985 | Nye, Jr. | 15/88.4 |
| 4,730,360 | 3/1988 | Brugelmann | 15/77 |
| 4,750,230 | 6/1988 | Osborn | 15/88.3 |
| 4,897,892 | 2/1990 | Bubien | 15/88.2 |
| 4,951,339 | 8/1990 | Braun | 15/88.3 |

*Primary Examiner*—Edward L. Roberts, Jr.
*Attorney, Agent, or Firm*—David P. Campbell

[57] ABSTRACT

A sport grip cleaning unit to be used at the location of the sporting activity. The cleaning unit consists of a vending operation under the control of the user. The unit consists of a two compartment cabinet whereby the user is able to control the cleaning action of the unit by the insertion of the sporting apparatus handle into the unit whereby the grip handle butt depresses a micro-switch activating the cleaning brushes. This action also causes the cleaning fluid pump to activate whereby the cleaning fluid floods the cleaning area to lubricate and flush accumulated grime, grit, and oils into the drain system where it is filtered and recycled. Thus the grip is restored to its desired tacky, firm hold condition. The sport grip cleaning unit includes a cleaning fluid reservoir that is removable from the unit for replacement with a new reservoir of cleaning fluid. In this manner, the cleaning unit is self-contained and can be easily serviced.

6 Claims, 4 Drawing Sheets

SPORTS EQUIPMENT GRIP CLEANER

TECHNICAL FIELD

The present invention relates to an apparatus for cleaning sport's equipment grips such as golf club grips, squash racket grips, tennis racket grips, racket ball grips, and the like.

BACKGROUND OF THE INVENTION

Hitting a ball in a racket sport or the game of golf requires that the athlete be able to securely grip the racket or club. In all cases the sport requires the player to firmly but gently grasp the handle or grip. This requires that the handle or grip be constructed of a rubberized or similar material which provide high friction between the grip and hands. However, to be effective, the grip must be clean and free of grease or other foreign matter that could cause the hand(s) to slip at ball impact. The problem is that during the course of play, the grasp area becomes lubricated with perspiration, dirt and body oil to the point that racket or club control is lost or degraded.

The problem of dirty grips has yet to be solved for the average person in a location where the individual may readily avail themselves of cleaning services. This grip cleaner is designed to be located where the sporting activity is taking place so the average sports' person is able to achieve the same grip cleanliness as the professional grip cleaner cleaning the grip by hand.

DISCLOSURE OF THE INVENTION

The depicted invention is generic in nature for the application of cleaning sporting equipment handles and grip areas. The difference between applications resides in the product dimensions as will be described in the discussion of the drawings. The device itself resembles a box with an opening in the front. The washer has an automatic dollar bill, or coin receiver, and will provide a specific limited cycle time. It is envisioned that one dollar will buy sufficient time to wash four or five golf grips and two racket type grips.

The cleaner is comprised of a formed cavity containing a set of three counter rotating brushes that surround the grip when it is inserted. These brushes are driven by an external motor via a cog belt. The washing fluid is pumped by an external pump from a reservoir via tubing to a wash tube fixed at the top of the wash chamber where the cleaning solution is forced under pressure over the brushes and grip area. As the brushes rotate they scrub the grip area. The constantly flowing cleaning solution carries off particulate and soluble material into the fluid reservoir at the bottom of the wash chamber where it is recycled into the main fluid reservoir. Cleaning of the grip area is achieved by the sport's person inserting the grip end of the racket or club into the receiver tube, through the center of the three brush scrub assembly, whereupon the end of the shaft contacts the end holder which provides a dual service. It holds the sport's equipment in place and is also the power switch. By pushing the sports' equipment into the cleaning chamber, the power switch is activated by the end of the shaft or handle and the device is turned on. After a user determined period of time the user removes the pressure from the sports' equipment which allows the spring loaded micro switch to turn off the unit whereby the user removes the equipment by reversing the entry procedure. This process is repeated until the user either cleans all equipment, or the unit times out.

DESCRIPTION OF THE PREFERRED EMBODIMENTS

This sport grip cleaning device is expected to find use in cleaning all types of handles and grips used in sporting equipment.

Figure 1:
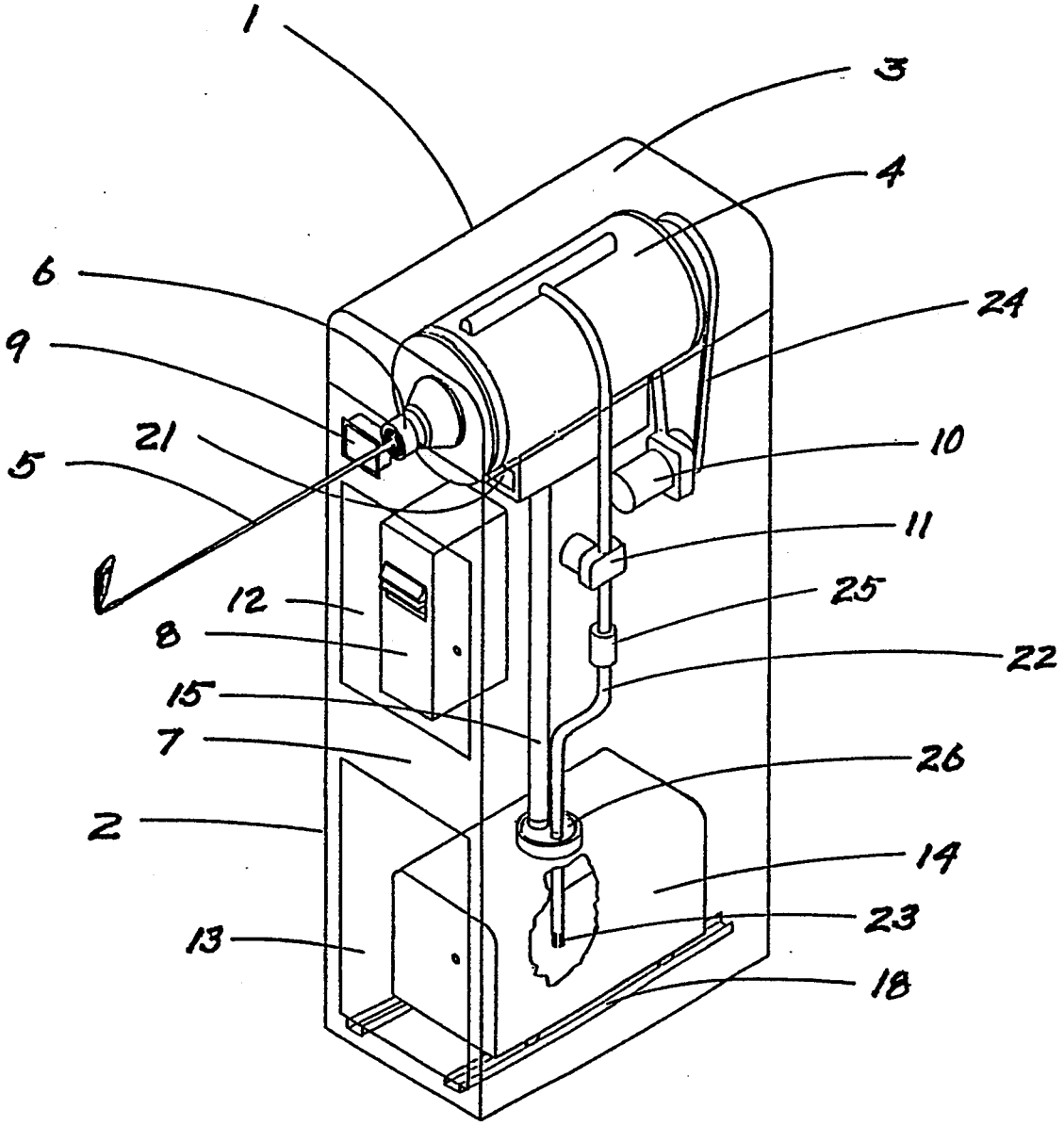
FIG. 1 is a view of the entire sport grip washer showing the outside case, upper and lower compartments, cleaning assembly, currency collector, status panel, drive motor, cleaning fluid pump, filter, and fluid reservoir.

FIG. 1 illustrates the overall grip cleaning design according to the present invention, indicated by the numeral 1. As depicted, the invention is contained in a rectangular cabinet that is comprised of two compartments to facilitate maintenance activities. The lower compartment 2 is designed to remain in place and the upper compartment 3 is designed to be removed to facilitate removal and replacement of the cleaning assembly 4 in the event of malfunction. The cleaning assembly 4 has accommodation for the insertion of the sport's equipment grip, a golf club grip in this example, 5 to a predetermined depth. The handle is inserted through a guide tube 6 where by it is centered between the brushes in the cleaning assembly 4. The front of the cabinet 7 also contains the revenue receiving device 8 as well as a status panel 9 containing a green light to indicate an activated state, a time remaining counter, and instructions for use. A cloth will also be fastened to the unit to allow the sport's person to wipe off the grip after washing. The upper portion of the cabinet 3 contains the cleaning assembly 4, drive motor 10 and pump assembly 11. These elements are attached to the top of the cabinet 3 for easy removal. By simply unscrewing the hold down bolts and lifting the assembly off the lower cabinet 2 the entire pumping and cleaning unit is serviced or replaced without moving the lower cabinet. The bill receiving unit 8 is accessed through the upper service door 12 on the front of the lower cabinet 2 for removal of the accumulated currency.

To facilitate cleaning fluid changing, the lower cabinet 2 contains a fluid reservoir access door 13 where the cleaning fluid reservoir 14 is located on a weight supporting drawer on rollers 18 for easy removal and servicing.

As shown in FIG. 1 the drive motor 10 and pump assembly 11 are electrically integrated such that power activation is through the bill collector 8 to the grip holding unit micro-switch FIG. 2-16 to the drive motor 10 and pump unit 11. The brush assembly FIG. 2-17 is driven via a cog drive belt 24 by the drive motor 10.

The pump unit 11 is powered by the same timed power source, thus the washer unit 4 is only under power whenever the sport's person has activated the unit; the timing of unit operation is thereby controlled by the user. The reservoir 14 provides a dual service. It provides a large supply of cleaning fluid to allow greater dispersion of the contaminants as well as a collection point for particulate matter. The reservoir 14 allows the particulate matter to settle out of the fluid so it is not reintroduced into the cleaning process. Both the drain hose 15 and the pick-up-tube 22 are routed through the reservoir filler cap 26. The pick-up tube 22 has a fine mesh screen 23 on the intake end which takes up fluid at the half way point in the fluid level to prevent disturbance of the settling process. At predetermined service intervals the fluid reservoir 14 is exchanged with a like unit and removed for draining, cleaning and replenishment for the next exchange. In this manner the fluid is maintained in a contained manner for ease of maintenance and disposal in an environmentally sound manner. The fluid is cleaned by filtering through an in line filter 25.

Figure 2:
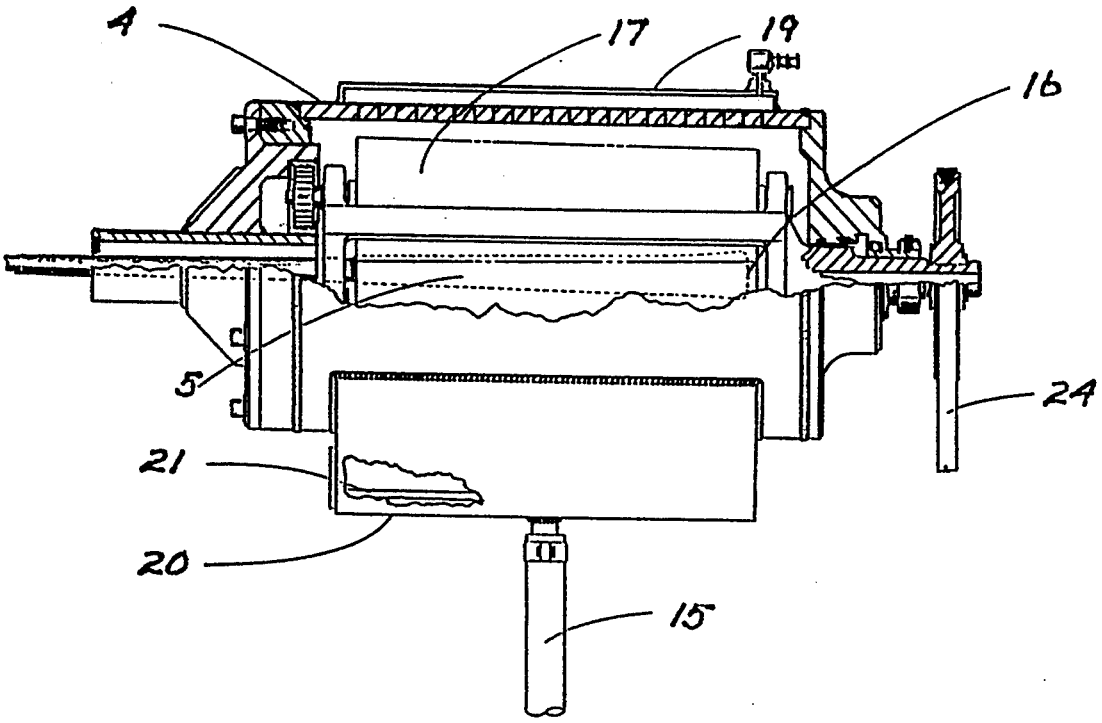
FIG. 2 is a view of the cleaning assembly depicting a golf club shaft and grip inserted in this version of the invention. The figure shows the cleaning brushes, catch basin with the course mesh screen and the drive belt.
Figure 4:
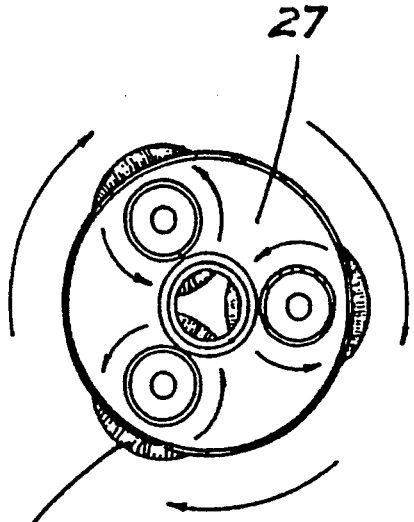
FIG. 4 is a side view of the cleaning brush assembly showing the three counter rotating brushes and the drive gears.

As shown in FIG. 2 a golf club grip 5, in this example of the sport grip washer, is inserted into the cleaning unit 4 where it depresses the grip holding micro-switch, 16 to turn the unit on. The depicted brushes 17 in a counter rotating action, impart a counter torque scrubbing motion against the grip 5.

As shown, the cleaning fluid is sprayed over the brushes to provide a cleaning solvent, and lubricant to the cleaning process via the spray bar 19 which is an integral part of the cleaning unit 4. This fluid flow and brushing action washes the accumulated salts, oils and other material off the grip. The fluid then flows to the bottom of the catch basin 20 where the large particulate matter is screened out by the course mesh screen 21. The bottom of the wash unit is serviceable through the front cash collection and screen maintenance access panel 12. This panel is hinged so that it may be opened to gain access to the bill collection hopper 8 and also allow the attendant to detach and remove the debris collection screen 21 for cleaning. This screen will provide for the removal of large particulate matter on a frequent basis and will thus prevent debris from clogging the drain hose 15.

Figure 3:
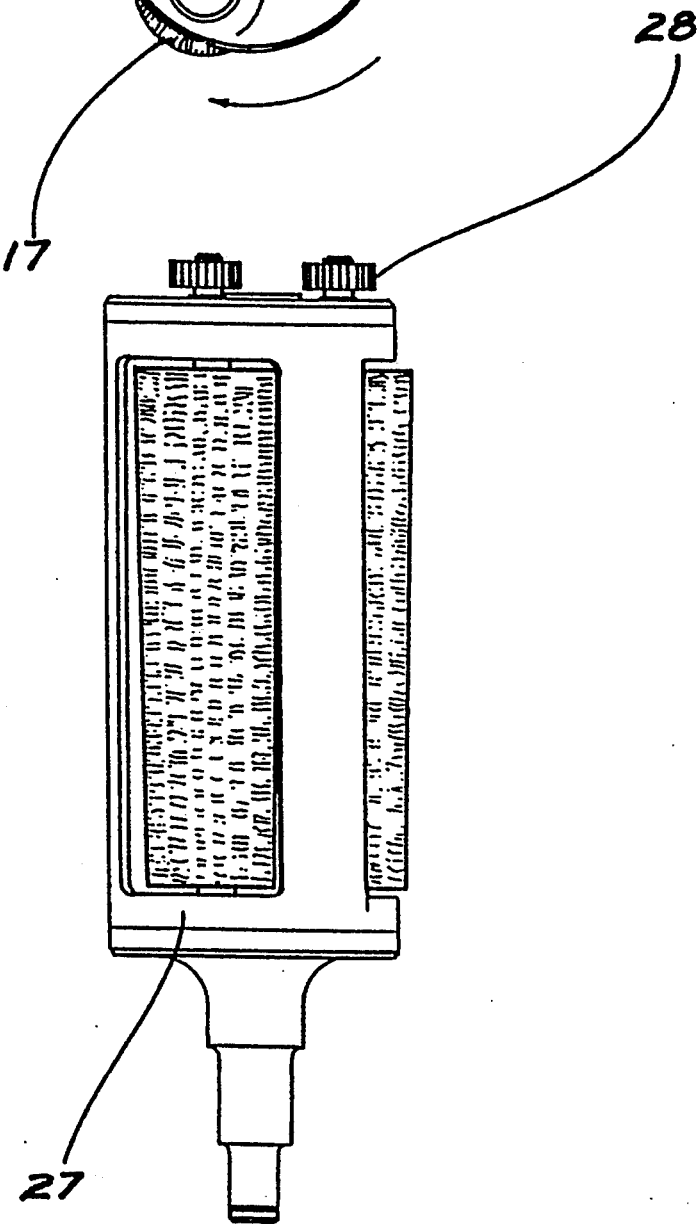
FIG. 3 is a front view of the cleaning brush assembly showing the three counter rotating brushes and the drive gears.

As shown in FIG. 3, the cleaning brush assembly consists of three counter rotating cleaning brushes 17 contained within a brush carrier housing 27 that is driven by a brush drive gear assembly 28. This assembly is designed such that the brushes carry the cleaning fluid to the surface of the grip and impart a light brushing action against the grip to dislodge embedded grit and remove grime and oils. The cleaning brushes 17 are also designed in a spiral twist such that they impart a retention force against the grip.

Figure 5:
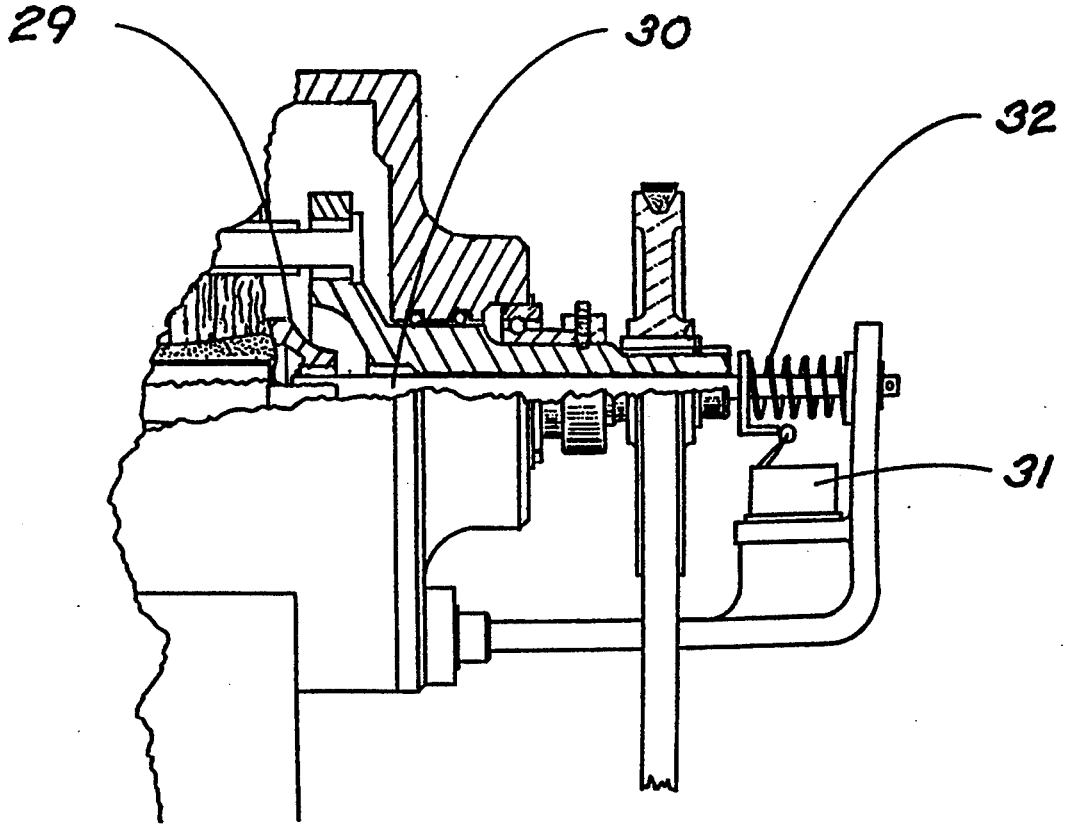
FIG. 5 is a view of the detail of the micro-switch power controller mechanism.

As depicted in FIG. 5, the power to the unit is controlled by the customer pressing the sports equipment handle butt against the grip handle socket 29 which imparts lateral movement to the actuator shaft 30, which in turn activates the micro-switch 31. This design ensures the unit is only activated when the sports equipment grip is in proper position to be cleaned. The micro-switch return spring 32 returns the unit to the off position when the pressure is removed from the handle socket 29, thereby turning off the unit when the sports equipment is removed from the cleaning position.

INDUSTRIAL APPLICABILITY

Thus, there has been disclosed a sport grip washer that with minimum changes in specification may be used for the cleaning of any one of several types of hand held sporting equipment without departing from the spirit of the invention, and all such changes and modifications are considered to fall within the scope of the invention, as defined by the appended claims.

We claim:

1. A grip cleaner, comprising:

a cabinet, a cleaning unit within the cabinet including at least two spaced-apart counter-rotatable cleaning brushes for scrubbing the grip, an opening for inserting the grip between the cleaning brushes, a nozzle for spraying cleaning fluid over the cleaning brushes, and a motor for rotating the cleaning brushes, a self-contained cleaning fluid reservoir in the cabinet for holding a supply of cleaning fluid, a pick-up tube for delivering cleaning fluid from the cleaning fluid reservoir to the nozzle, a hose for delivering cleaning fluid from the cleaning unit to the cleaning fluid reservoir, and a fluid pump in the cabinet for circulating the cleaning fluid, wherein the self-contained cleaning fluid reservoir is removable from the pick-up tube and the hose for replacement with a new reservoir of cleaning fluid.

2. The grip cleaner of claim 1, and further comprising a drawer mounted within the cabinet for removably supporting the cleaning fluid reservoir and allowing the cleaning fluid reservoir to be easily removed from the cabinet and replaced.

3. The grip cleaner of claim 1, and further including a housing for the grip cleaner, the housing including an access door adjacent the cleaning fluid reservoir, providing access to the cleaning fluid reservoir for replacement thereof.

4. The grip cleaner of claim 1, wherein the cleaning fluid reservoir includes a filler cap providing a coupling between the cleaning fluid reservoir and the drain hose and pick-up tube, the filler cap allowing for quick separation of the cleaning fluid reservoir from the drain hose and pick-up tube.

5. The grip cleaner of claim 1, wherein the cleaning unit further comprises a control switch opposite the opening in the cleaning unit for activating the pump and the motor, the control switch adapted to activate the pump and the motor upon being depressed by the grip.

6. The grip cleaner of claim 1, and further comprising a revenue-receiving device for locking out operation of the grip cleaner until proper payment has been made.

* * * * *